US006485170B2

(12) United States Patent
Natsume

(10) Patent No.: US 6,485,170 B2
(45) Date of Patent: Nov. 26, 2002

(54) VEHICULAR LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/943,684

(22) Filed: Aug. 31, 2001

(65) Prior Publication Data

US 2002/0030998 A1 Mar. 14, 2002

(30) Foreign Application Priority Data

Sep. 11, 2000 (JP) ..... 2000-275614

(51) Int. Cl.[7] ..... F21V 1/00

(52) U.S. Cl. ..... 362/509; 362/517; 362/326; 362/328; 359/839

(58) Field of Search ..... 362/509, 517, 362/326, 328; 359/839

(56) References Cited

U.S. PATENT DOCUMENTS 1,472,639 A * 10/1923 Dorey
4,899,261 A * 2/1990 Blusseau et al. ..... 362/61
5,260,856 A * 11/1993 Perthus et al. ..... 362/61
5,287,101 A * 2/1994 Serizawa ..... 340/815
5,477,440 A * 12/1995 Brun ..... 362/298
5,603,561 A 2/1997 Ohishi ..... 362/80
5,692,824 A * 12/1997 Ooishi ..... 362/80
5,746,497 A 5/1998 Machida ..... 362/80
6,019,492 A 1/2000 Ikegaya et al. ..... 362/521
6,050,705 A * 4/2000 Kusserow et al. ..... 362/299
6,332,701 B1 * 12/2001 Yamada et al. ..... 362/517

* cited by examiner

*Primary Examiner*—Sandra O'Shea
*Assistant Examiner*—Jacob Y. Choi
(74) *Attorney, Agent, or Firm*—Fish & Richardson P.C.

(57) ABSTRACT

A lamp chamber is defined by a translucent cover and a lamp body supporting a light source bulb. A translucent panel is provided within the lamp chamber. A front surface of the translucent panel is half mirror-treated. An upstanding wall portion extends in a fore-aft direction in the lamp body to surround the translucent panel. A plurality of quasi-reflector elements are formed in an inner surface of the upstanding wall portion. The half mirror portion is inclined at a predetermined angle with respect to the upstanding wall portion. When the lamp is off, a reflection of the quasi-reflector elements of the upstanding wall portion is seen in the half mirror portion.

8 Claims, 18 Drawing Sheets

VEHICULAR LAMP

BACKGROUND OF THE INVENTION

The invention relates to a vehicular lamp and, more particularly, to a structure for improving the appearance of the vehicular lamp.

Generally, a vehicular lamp has a light source, a lamp body supporting the light source, and a translucent cover attached to the lamp body. In a conventional vehicular lamp, the structural appearance of the lamp does not significantly change when it is on or off. However, if a translucent cover (light cover) of a lamp has been half mirror-treated as disclosed in Japanese Utility Model Application Laid-Open No. HEI 2-22505, the lamp interior is visible when the lamp is turned on. When the lamp is off, the lamp interior is invisible because of the external light reflection of the translucent cover. Thus, the appearance of the lamp changes when the lamp is switched on or off.

However, since the translucent cover of the vehicular lamp described in the aforementioned Japanese application is only half mirror-treated, the translucent cover of the lamp when turned off shows a whitish reflection of a scene ahead of the lamp. The reflection is similar to that of a widow pane attached with a half mirror film.

SUMMARY OF THE INVENTION

The present invention provides structures of a vehicular lamp that is half mirror-treated. That is, a vehicular lamp in accordance with the invention includes a light source and a translucent panel provided in front of the light source. An upstanding wall portion extends substantially in a fore-aft direction to surround at least a portion of the translucent panel. A plurality of quasi-reflector elements are formed in an inner surface of the upstanding wall portion. At least a portion of the translucent panel is formed as a half mirror that has been half mirror-treated. The half mirror portion is inclined at a predetermined angle with respect to the upstanding wall portion. Thus, a reflection of the upstanding wall portion in the half mirror portion is observed when the lamp is turned off.

As long as the translucent panel is provided in front of the light source, other members of the vehicular lamp are not limited in terms of specific configuration of the lamp body.

The light source may be, for example, an incandescent bulb or an LED (light-emitting diode). Furthermore, the number of the light sources may be more than one.

As long as the translucent panel is provided in front of the light source, It may be an outer panel (translucent cover) exposed at a front face of the lamp or may be an inner panel provided rearwardly. The translucent panel may be transparent and may have lens elements integrated therein.

The specific construction of the upstanding wall portion is not particularly limited as long as the upstanding wall portion extends substantially in a fore-aft direction to surround at least a portion of the translucent panel. The upstanding wall portion may be formed as an independent. member or may be formed as a portion of a lamp body or a vehicle body-side member.

The specific configuration of the quasi-reflector elements is not particularly limited as long as the elements are formed in the inner surface of the upstanding wall portion in a projections-and-depressions manner. For example, the quasi-reflector elements may be cylindrical elements, fish-eye elements, or pyramidal elements, which extend in a fore-aft direction or a circumferential direction.

The angle of inclination of the half mirror portion with respect to the upstanding wall portion and the position of formation thereof in the translucent panel are not particularly limited as long as the half mirror portion is formed so that when the half mirror portion is observed with the lamp turned off, a reflection of he upstanding wall portion is seen in the half mirror portion.

As described above, in the vehicular lamp in accordance with the invention, at least a region in the translucent panel provided in front of the light source is formed as a half mirror portion that has been half mirror-treated. Therefore, when the lamp is on, a lamp interior can be seen, and when the lamp is off, the lamp interior behind the half mirror portion cannot be seen because of the external light reflecting off the half mirror portion. Thus, the visual appearance of the lamp is changed when the lamp is turned on or off.

Furthermore, at least a portion surrounding the translucent panel is provided with the upstanding wall portion extending substantially in the fore-aft direction, and a plurality of quasi-reflector elements are formed in the inner surface of the upstanding wall portion, and the half mirror portion is inclined at a predetermined angle with respect to the upstanding wall portion so that a reflection of the upstanding wall portion is observed in the half mirror portion when the lamp is turned off. Therefore, an image of the plurality of quasi-reflector elements formed in the inner surface of the upstanding wall portion can be reflected in the half mirror portion.

Thus, according to the invention, the appearance of the lamp is improved in comparison with the conventional vehicular lamp, which when turned off shows a whitish reflection of a scene ahead of the translucent cover of the lamp.

Color may be provided to the inner surface of the upstanding wall portion.

The half mirror portion can be a curved plane so that the plurality of quasi-reflector elements formed in the inner surface of the upstanding wall portion can be shown distorted reflectively.

Furthermore, the vehicular lamp may include a lamp body that supports the light source, and a translucent cover that is attached to the lamp body and that defines a lamp chamber together with the lamp body. The translucent panel may be provided in the lamp chamber, and the upstanding wall portion may be formed as a portion of the translucent cover or the lamp body. Therefore, the configuration of the translucent panel can be relatively freely set. Furthermore, the positional precision of the upstanding wall portion can be enhanced. Thus, the half mirror portion can substantially reflect light as intended.

Furthermore, the lamp may include a reflector for forwardly reflecting light from the light source, and the reflector may have a plurality of reflector elements. Therefore, when the lamp is on, the reflector elements can be seen. Hence, it becomes possible to greatly change the appearance when the lamp is switched on or off.

The reflector may be formed independently, or may be integrated into the lamp body or the like.

Still further, if a region in the translucent panel in front of the light source is formed as an opening or is not half mirror-treated, the following operational advantages can be achieved.

Since the half mirror portion partly reflects light incident thereon, the half mirror portion causes a fraction of the light emitted forwardly from the light source to be lost. However, the region of the translucent panel contributes relatively little to the reflection of the upstanding wall portion. Thus, if the region is formed as an opening or formed as a surface that is not half mirror-treated, the lamp can achieve a sufficient light luminosity while still substantially reflecting the upstanding wall portion.

Furthermore, the appearance of the non-half mirror portion or the opening and the appearance of the other portion of the translucent panel are distinguished from each other when the lamp is off. Therefore, the appearance of the lamp can be further enhanced.

The translucent panel can be formed to extend in a substantially horizontal direction in a generally trapezoidal longitudinal sectional shape, and each of an upper portion and a lower portion of the translucent panel can be formed as the half mirror portion. A central portion of the translucent panel in an up-down direction can be formed as the non-half mirror portion, and the central portion in the up-down direction can have a plurality of lens elements. In this configuration, a lamp interior can be prevented from being clearly seen through the non-half mirror portion. Furthermore, the lamp light distribution can be easily controlled.

The plurality of lens elements may be formed either in an inner surface or an outer surface of the translucent panel.

DETAILED DESCRIPTION OF THE EMBODIMENTS

Figure 1:
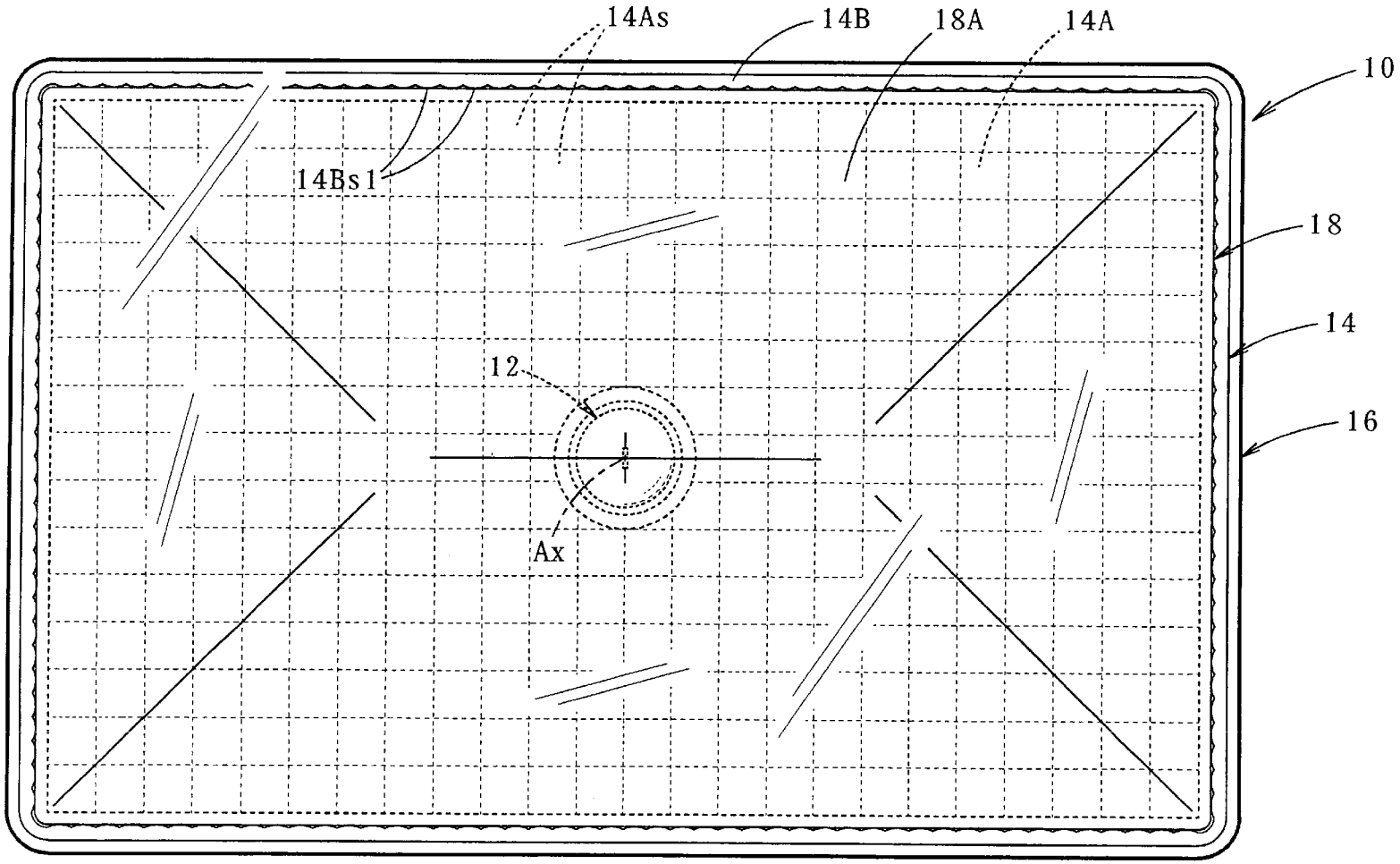
FIG. 1 is an elevation of a vehicular lamp in accordance with an embodiment of the invention.
Figure 2:
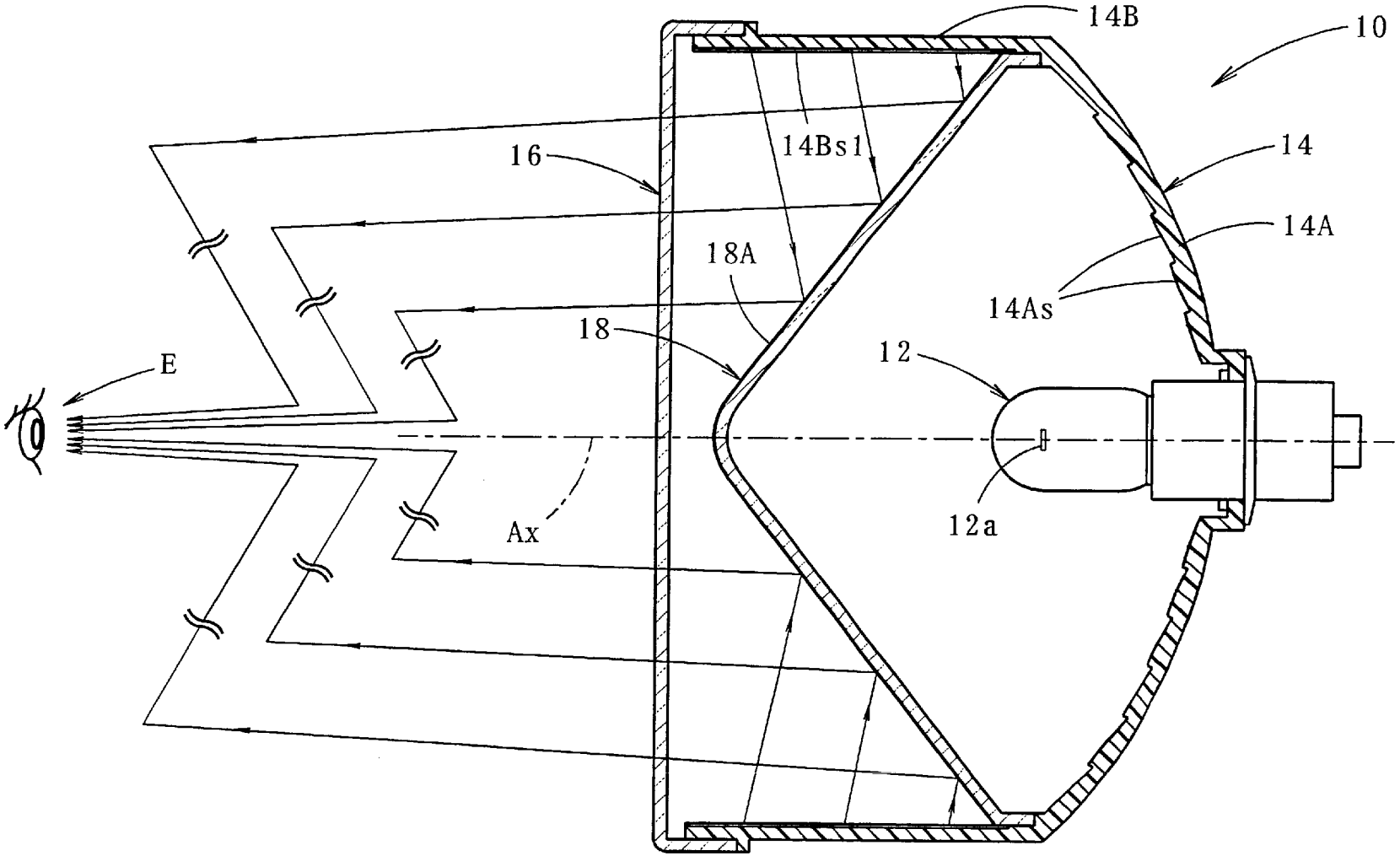
FIG. 2 is a side sectional view of a vehicular amp with the lamp turned off in accordance with an embodiment of the invention.
Figure 3:
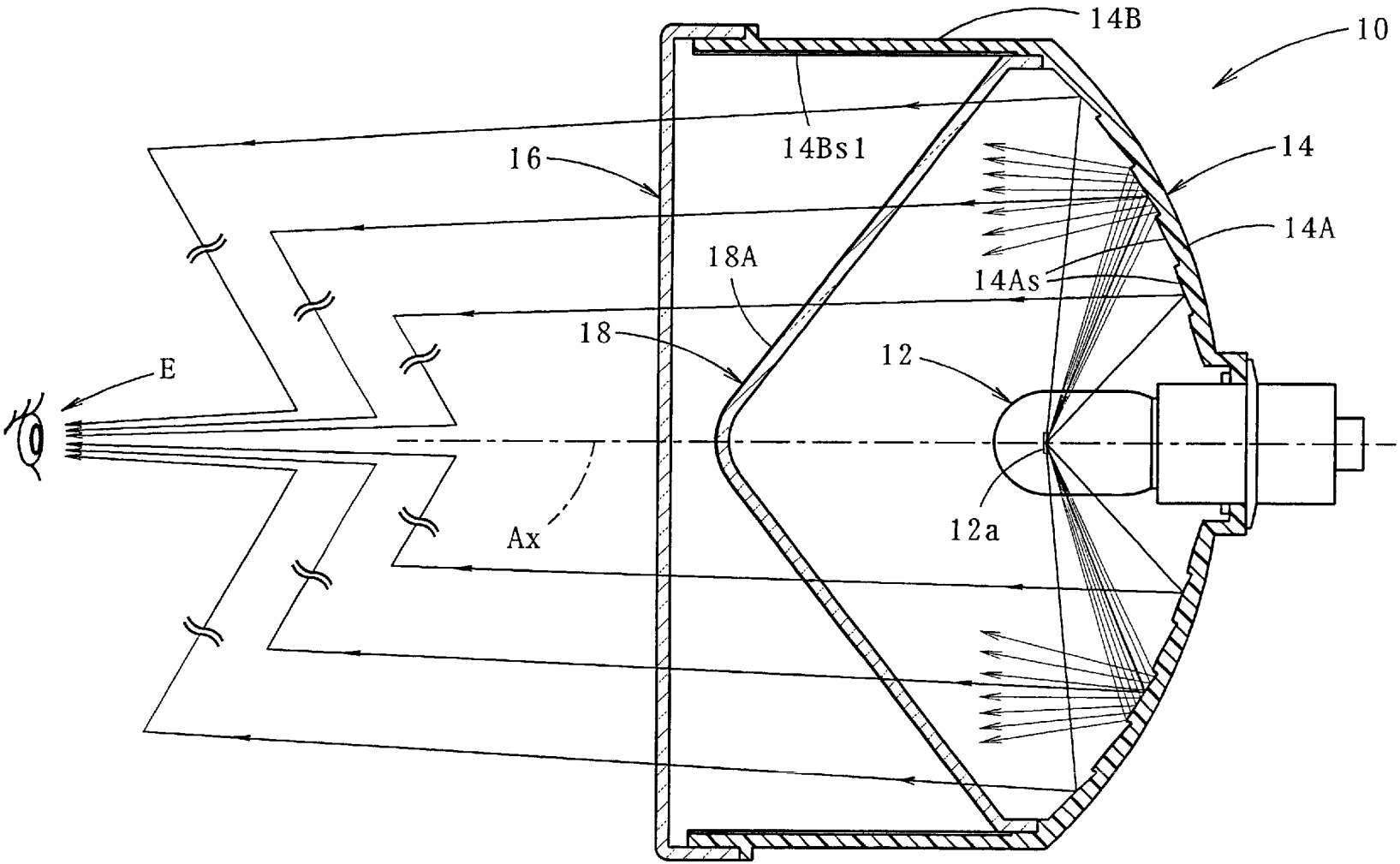
FIG. 3 is a sectional view of a vehicular lamp with the lamp turned on in accordance with an embodiment of the invention.

FIG. 1 is a front view of a vehicular lamp 10 in accordance with a first embodiment of the invention. FIGS. 2 and 3 are side sectional views of the vehicular lamp 10. FIG. 2 illustrates how the lamp looks when turned off. FIG. 3 illustrates how the lamp looks when turned on.

As shown in these drawings, the vehicular lamp 10 of the embodiment is a stop lamp having a laterally elongated rectangular outline configuration. The vehicular lamp 10 has a light source bulb (incandescent bulb) 12 disposed on an optical axis Ax extending in a vehicle fore-aft direction, a lamp body 14 that supports the light source bulb 12, a see-through translucent cover 16 that is attached to the lamp body 14 and defines a lamp chamber together with the lamp body 14, and a translucent panel 18 provided to assume a position between the translucent cover 16 and the lamp body 14.

The lamp body 14 includes a reflector portion 14A (reflector) that reflects light from a filament 12*a* (light source) of the light source bulb 12 in a forward direction (forward direction with respect to the lamp which is a rearward direction with respect to the vehicle—the same applies in the description below), and an upstanding wall portion 14B extending forward from an outer peripheral edge portion of the reflector portion 14A. An outer peripheral edge portion of the translucent cover 16 is fixed and supported to a forward end portion of the upstanding wall portion 14B. An outer peripheral edge portion of the translucent panel 18 is fixed and supported to a rearward end portion of the upstanding wall portion 14B.

An inner surface of the reflector portion 14A is divided into segments in a lattice fashion. A plurality of reflector elements 14As are formed in the segments.

Each reflector element 14As has a convex curved surface that conforms to a paraboloid whose center axis is the optical axis Ax and whose focal point is at the position of the filament 12*a* on the optical axis Ax. Each reflector element 14As is designed to reflect light from the filament 12*a* in a diffusing fashion within predetermined angles, extending in up-down and right-left directions about an axis parallel to the optical axis Ax.

The upstanding wall portion 14B extends along the entire outer peripheral edge portion of the reflector portion 14A. In an inner surface of the upstanding wall portion 14B, a plurality of quasi-reflector elements 14Bs1 extending in the fore-aft direction are formed at equal pitches along the entire length of the periphery of the upstanding wall portion 14B.

The translucent panel 18 extends in a substantially horizontal direction with a letter L-like longitudinal sectional shape pointing forward. The translucent panel 18 is formed so that when the lamp is seen in a front view, a ridge of a hipped roof as shown in FIG. 1 appears.

A forward surface of the translucent panel 18 is half mirror-treated by aluminum vacuum vapor deposition or the like. The entire area thereof is formed as a half mirror portion 18A.

The half mirror portion 18A is formed as inclined surfaces that are inclined at a predetermined angle (about 50° in this embodiment) with respect to the upstanding wall portion 14B.

The operation and advantages of the embodiment will be described next.

Figure 4B:
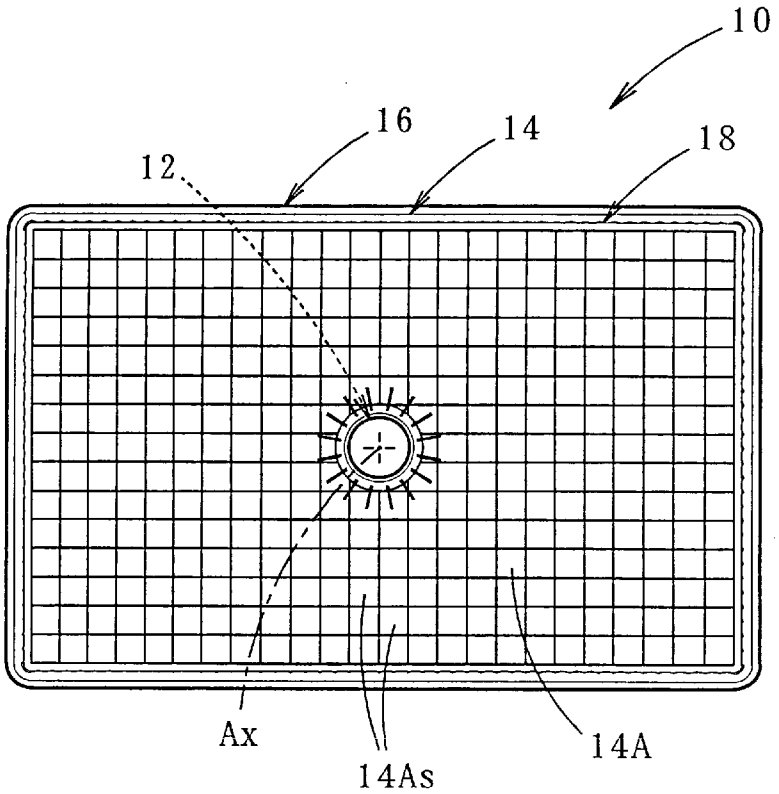
FIGS. 4(*a*) and 4(*b*) illustrates a vehicular lamp turned off and on, respectively, in accordance with an embodiment of the invention.
Figure 4A:
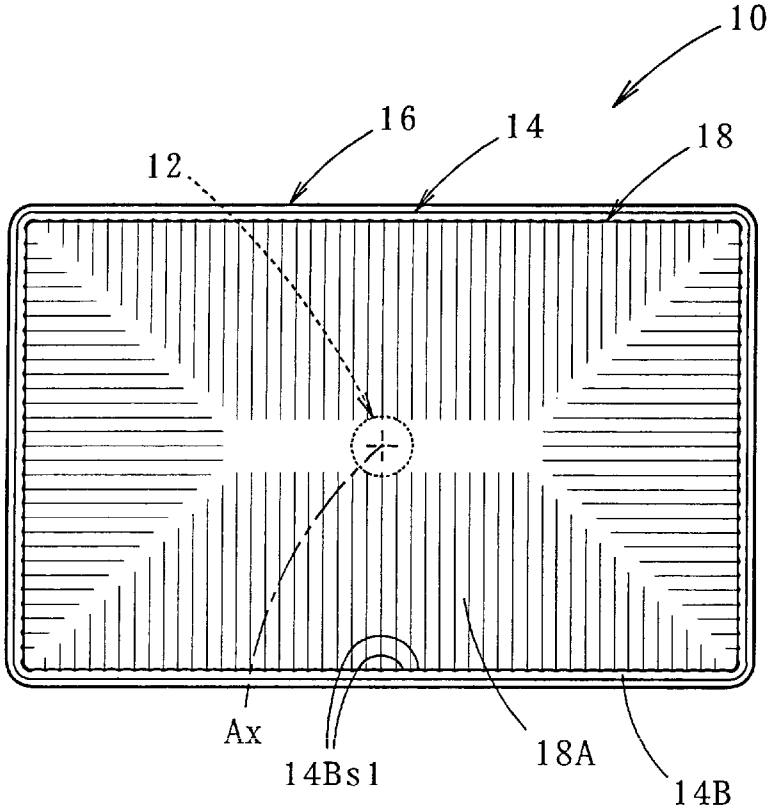

When the light source bulb 12 of the vehicular lamp 10 is turned off, a reflection of the upstanding wall portion 14B in the half mirror portion 18A is seen from an eye point E on the optical axis Ax because the external light is reflected from the half mirror portion 18A, as shown in FIG. 2. Therefore, as shown in FIG. 4(*a*), the vehicular lamp 10 is seen as a pattern of vertical and horizontal stripes, which are the reflected images of the plurality of quasi-reflector elements 14Bs1 formed in the inner surface of the upstanding wall portion 14B.

In contrast, when the light source bulb 12 is turned on, light from the light source bulb 12 is reflected from the reflector portion 14A and is transmitted through the translucent panel 18. At the eye point E, the vehicular lamp 10 reveals a lattice-like design pattern of the plurality of reflector elements 14As forming the reflector portion 14A, as shown in FIG. 4(*b*).

Thus, according to this embodiment, the appearance of the lamp changes when the lamp is turned on or off. Furthermore, when the lamp is off, the inner surface of the upstanding wall portion 14B with the plurality of quasi-reflector elements 14Bs1 is reflected from the half mirror portion 18A. Hence, in comparison with the conventional vehicular lamp that shows a whitish reflection of a scene ahead of the translucent cover of the lamp, the lamp according to the embodiment of the present invention has an improved appearance.

A second embodiment of the invention will be described next.

Figure 5:
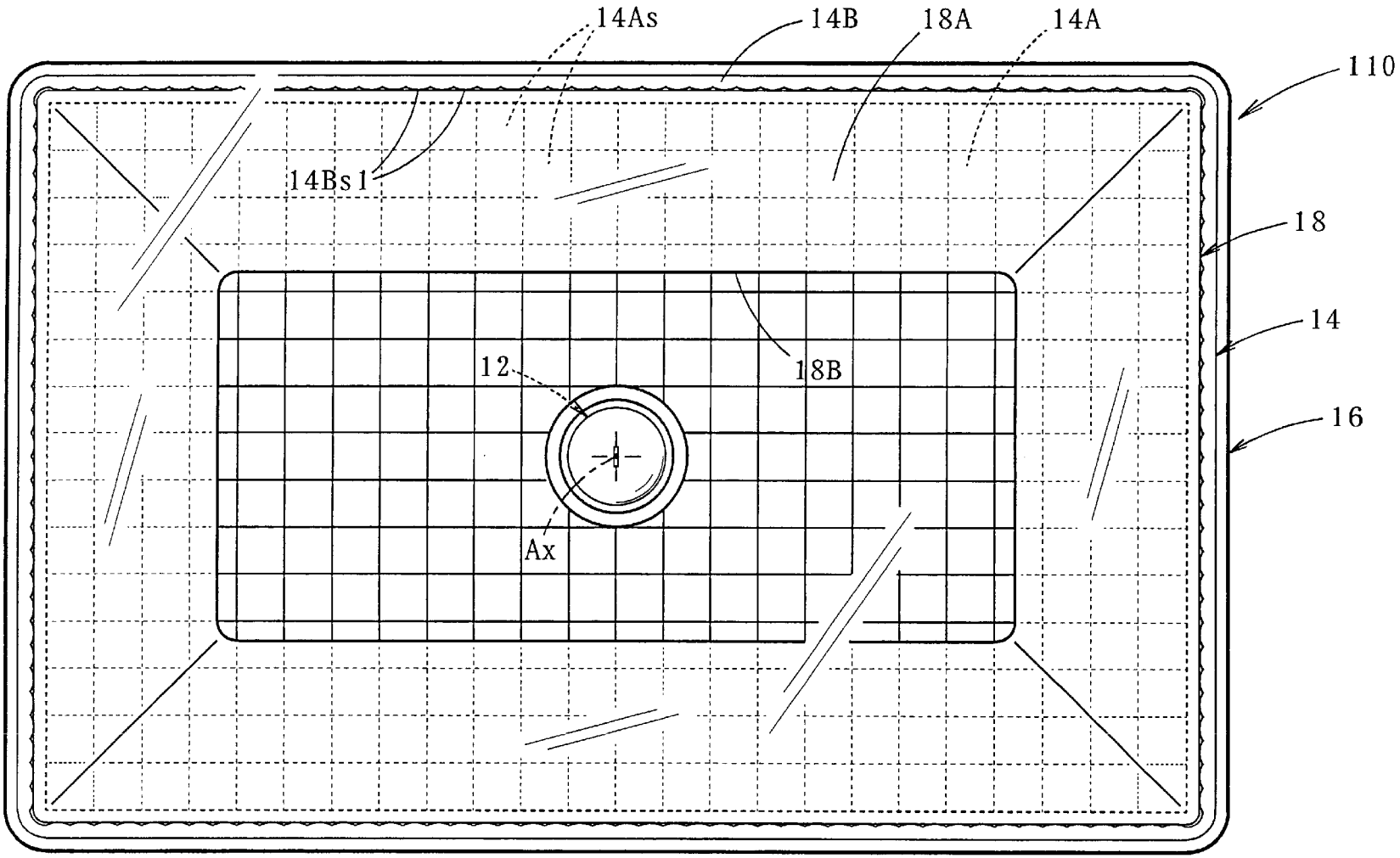
FIG. 5 is an elevation of a vehicular lamp in accordance with another embodiment of the invention.
Figure 6:
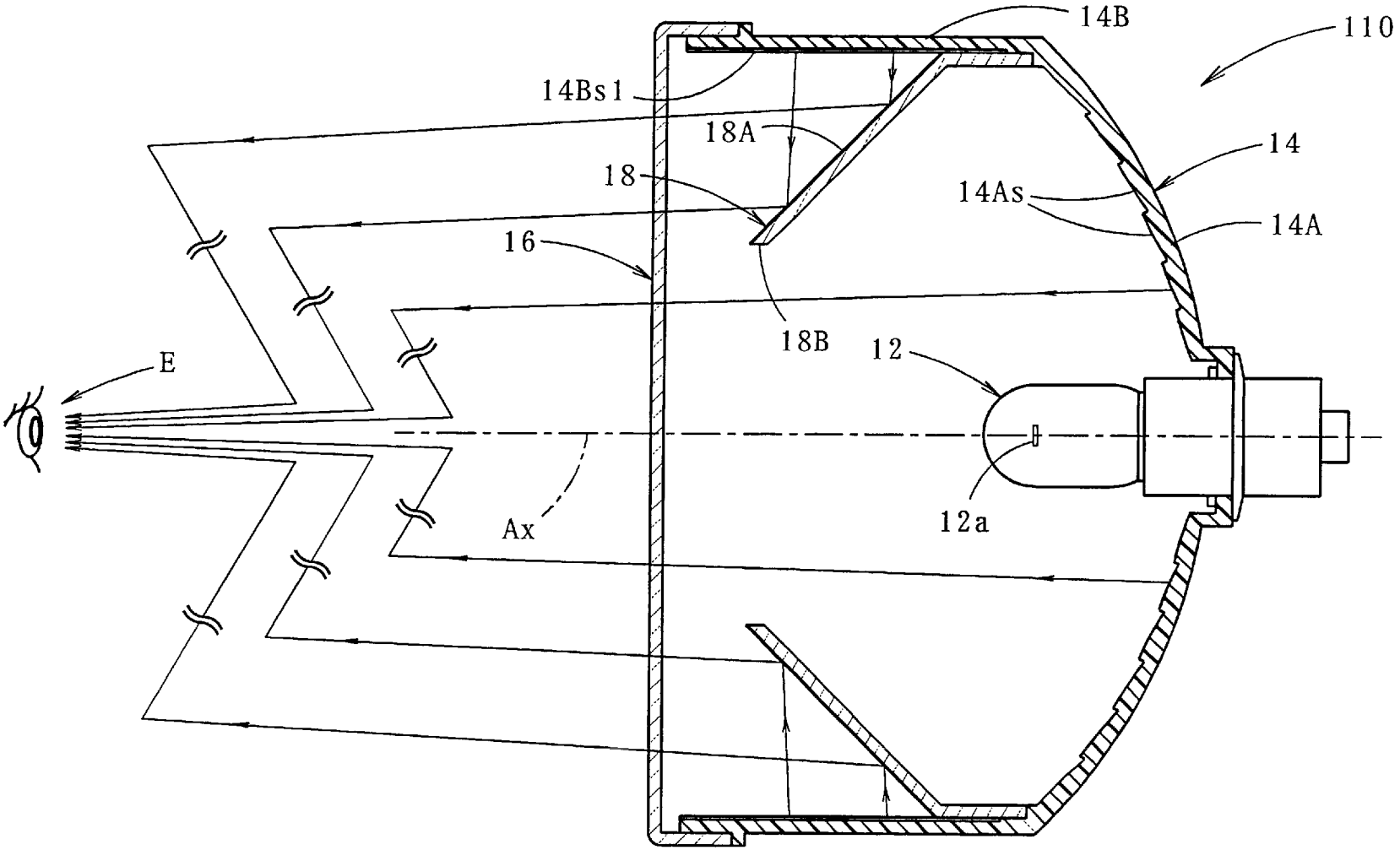
FIG. 6 is a side sectional view of a vehicular lamp turned off in accordance,with an embodiment of the invention.
Figure 7:
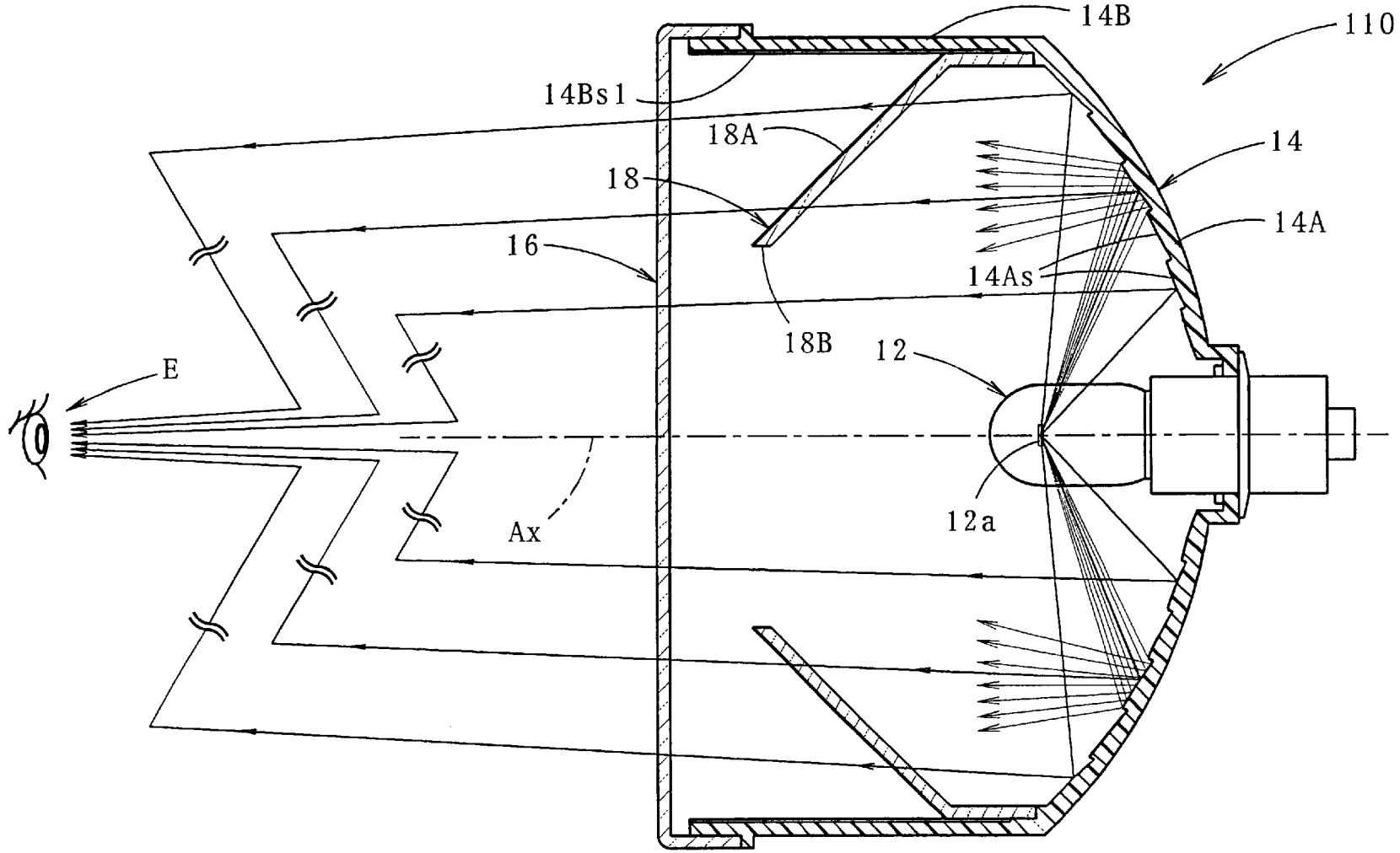
FIG. 7 is a sectional view of a vehicular lamp turned on in accordance with the second embodiment.

FIG. 5 is a front view of a vehicular lamp 110 in accordance with the second embodiment. FIGS. 6 and 7 are side sectional views of the vehicular lamp 110. FIG. 6 illustrates how the lamp looks when turned off. FIG. 7 illustrates how the lamp looks when turned on.

As illustrated in these drawings, the vehicular lamp 110 of this embodiment differs from the lamp of the first embodiment in the construction of a translucent panel 18. Otherwise, the embodiment is substantially the same as the first embodiment.

In the second embodiment, the translucent panel 18 has an opening 18B having a laterally elongated rectangular shape with the center being the optical axis Ax. An area surrounding the opening 18B of the translucent panel 18 is constructed in substantially the same manner as in the first embodiment.

That is, the entire area of the forward surface of the surrounding area is formed as a half mirror portion 18A. The half mirror portion 18A is inclined at a predetermined angle (about 45° in this embodiment) with respect to the upstanding wall portion 14B.

The operation and advantages of the embodiment will be described next.

When the light source bulb 12 of the vehicular lamp 110 is off, a reflection of the upstanding wall portion 14B in the half mirror portion 18A is seen from an eye point E on the optical axis Ax because of the external light reflecting off the half mirror portion 18A, as shown in FIG. 6.

Figure 8B:
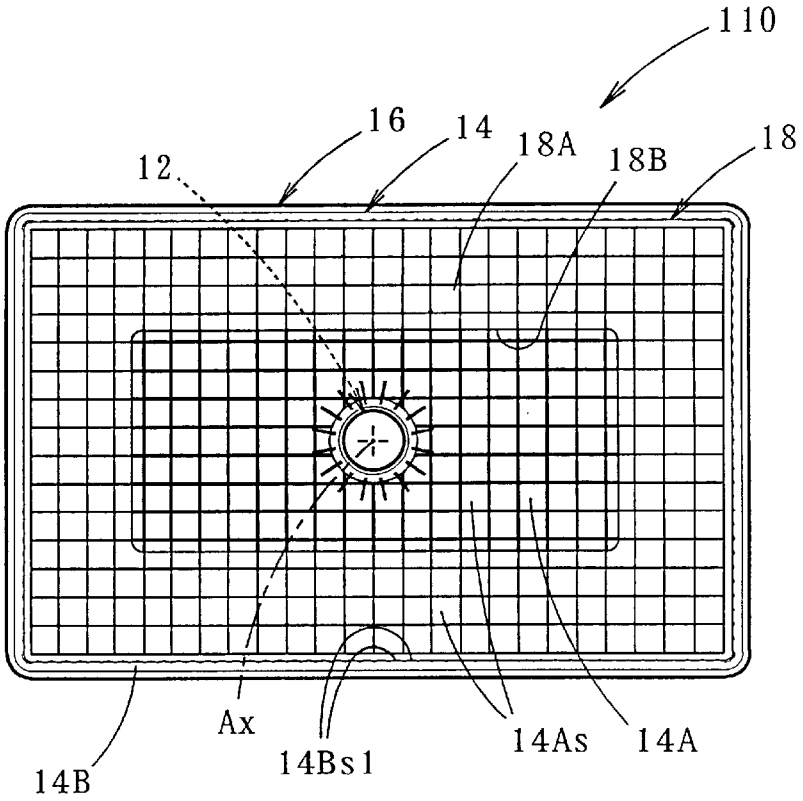
FIGS. 8(*a*) and 8(*b*) are elevations of a vehicular lamp turned off and on, respectively, in accordance with an embodiment of the invention.
Figure 8A:
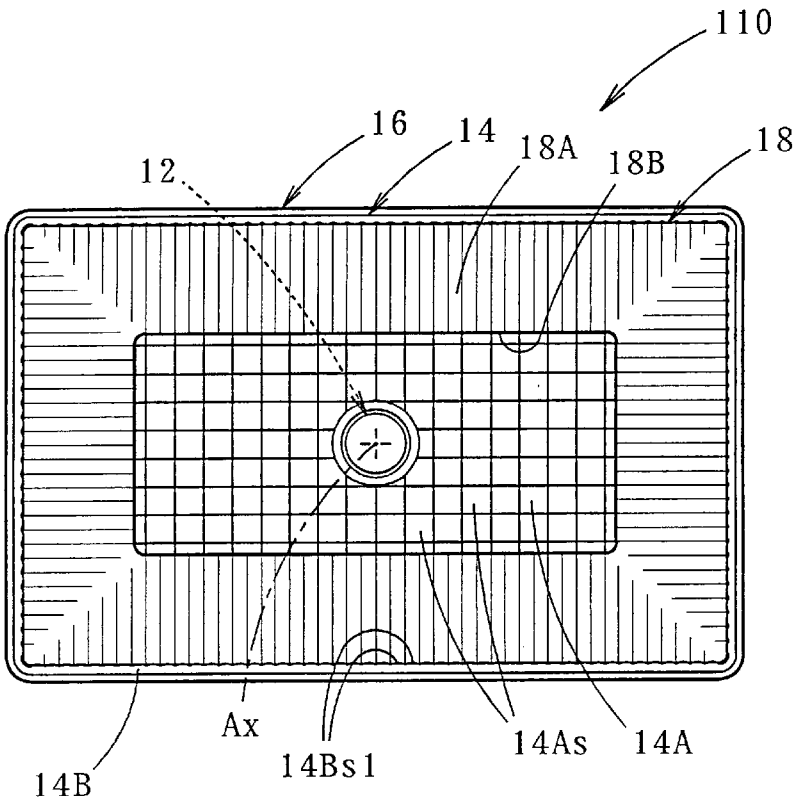

Therefore, as shown in FIG. 8(*a*), the vehicular lamp 110 is seen as a reflected pattern of vertical and horizontal stripes of the plurality of quasi-reflector elements 14Bs1 formed in the inner surface of the upstanding wall portion 14B. However, the lattice-like design of plurality of reflector elements 14As of the reflector portion 14A is visible through the opening 18B.

In contrast, when the light source bulb 12 is on, light from the light source bulb 12 reflected from the reflector portion 14A is visible from the eye point E not only in the portion provided as the opening 18B but also in the portion surrounding the opening 18B, as shown in FIG. 7. Therefore, the vehicular lamp 110 appears with a lattice-like design of the plurality of reflector elements 14As forming the reflector portion 14A, as shown in FIG. 8(*b*).

However, a certain fraction of the reflected light from the reflector portion 14A incident on the translucent panel 18 is reflected by the half mirror portion 18A. Therefore, the luminosity of light through the translucent panel 18 is less than the luminosity of light through the opening 18B.

Therefore, the lattice-like design of the reflector elements 14As appears slightly darker in the area of the half mirror portion 18A than in the area of the opening 18B.

Thus, this embodiment also changes the appearance of the lamp when the lamp is switched on or off, but in a manner different from the first embodiment.

That is, in this embodiment, when the lamp is off, the inner surface of the upstanding wall portion 14B having the plurality of quasi-reflector elements 14Bs1 is reflected in the half mirror portion 18A. In comparison, the conventional vehicular lamp when turned off shows only a whitish reflection. of a scene ahead of the lamp. Thus, the lamp of the present invention gives an improved appearance.

Furthermore, in this embodiment, a portion of the translucent panel 18 is formed as the opening 18B. Therefore, the luminosity of light emitted forwardly through the opening 18B is not reduced, unlike the light emitted forwardly through the half mirror portion 18A.

Furthermore, the opening 18B is formed in an area near the optical axis Ax of the translucent panel 18, which marginally contributes to the reflection of the upstanding wall portion 14B. Therefore, the lamp can easily secure a sufficient lamp light distribution while substantially maintaining the reflection of the upstanding wall portion 14B.

Figure 9:
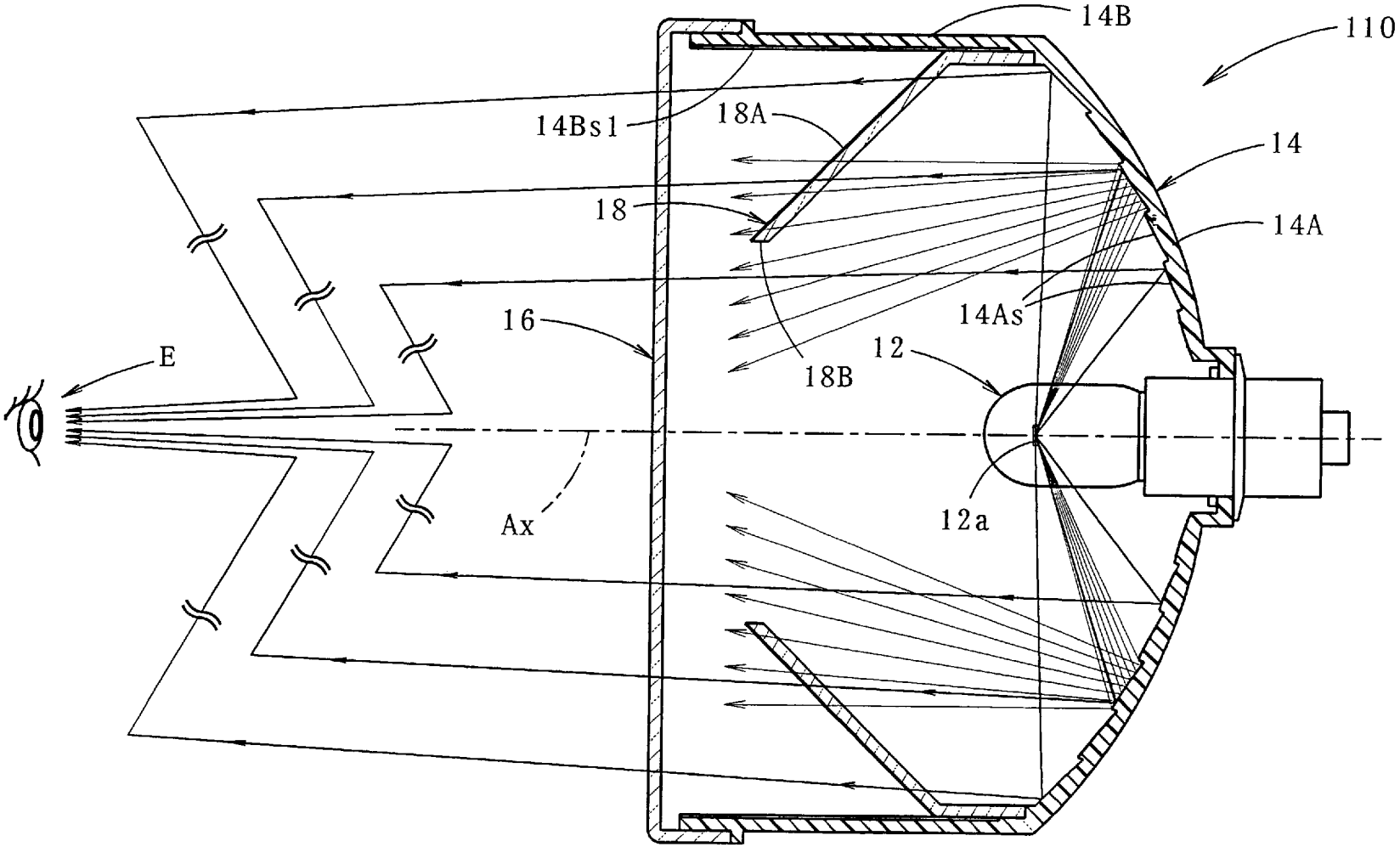
FIG. 9 is a diagram similar to FIG. 7, illustrating a first modification of the embodiment.

FIG. 9 is a diagram similar to that of FIG. 7, showing a first modification of the second embodiment.

As shown in FIG. 9, the construction of a plurality of reflector elements 14As formed in the reflector portion 14A differs from that of the second embodiment.

That is, each reflector element 14As has a convex curved surface that conforms to a paraboloid whose center axis is the optical axis Ax and whose focal point is at the position of the filament 12*a* on the optical axis Ax. However, the convex curved surface of each reflector element 14As has a configuration in which an outer periphery-side end portion of the curved surface is displaced forward in comparison with the convex curved surface in the second embodiment. Also, the element 14As diffusely reflects light from the filament 12*a* closer toward the optical axis Ax than in the second embodiment. Or more specifically, the element 14As reflects light in a range from the direction of an axis parallel to the optical axis Ax to a diagonal direction toward the optical axis Ax.

By adopting such a construction, more light can be emitted forwardly through the opening 18B while causing a portion of the reflected light from each reflector element 14As to be incident on the eye point B located forwardly in the direction of the optical axis Ax.

Therefore, the lamp can easily secure a quantity of light needed for the lamp light distribution while allowing reflector elements 14As to reflect light unimpeded through the opening 18B.

Figure 10:
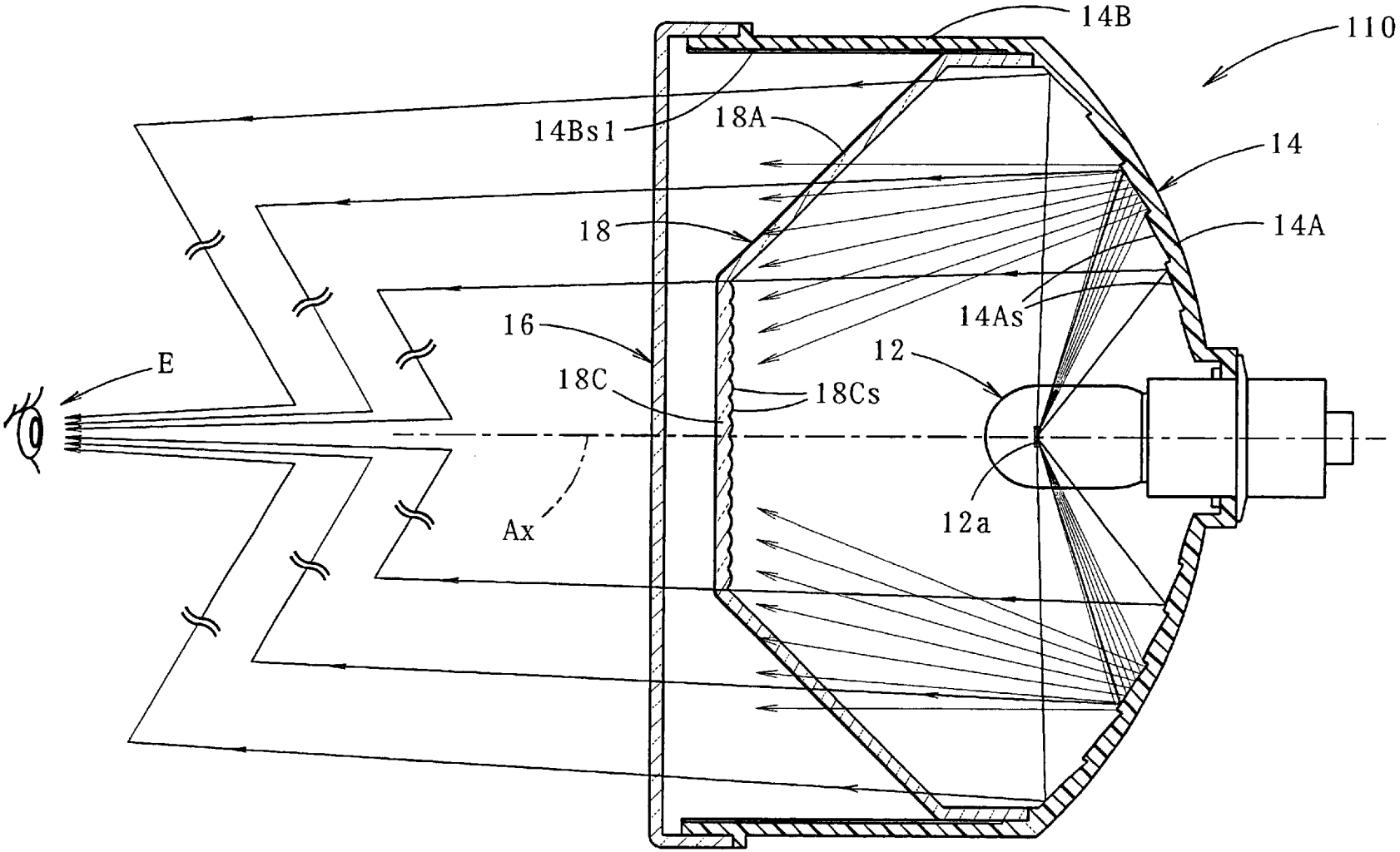
FIG. 10 is a diagram similar to FIG. 7, illustrating a second modification of the embodiment.
Figure 11B:
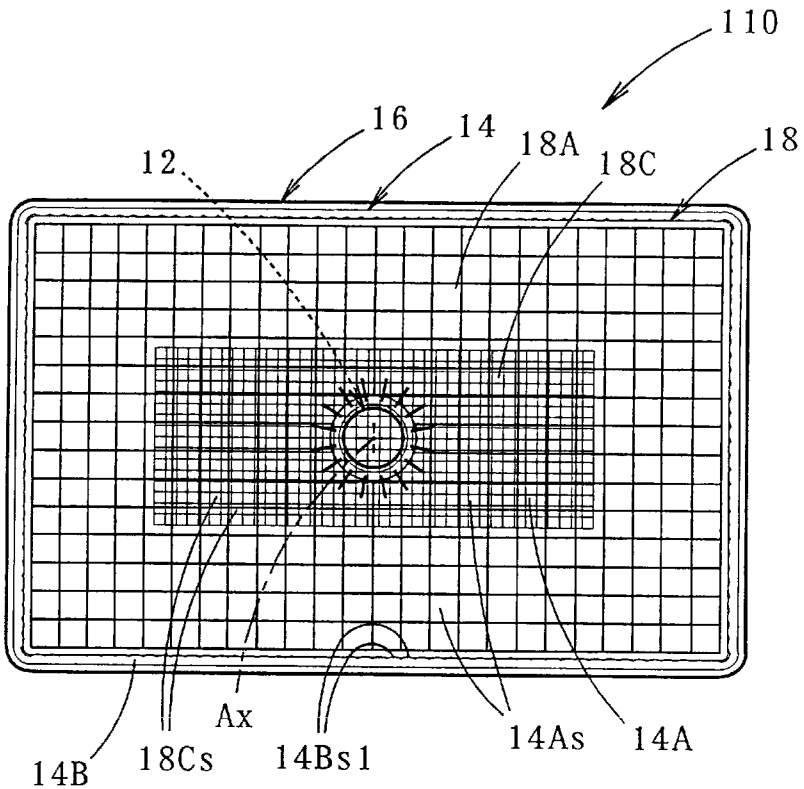
FIG. 11 are diagrams similar to FIG. 8, illustrating an operation of the second modification.
Figure 11A:
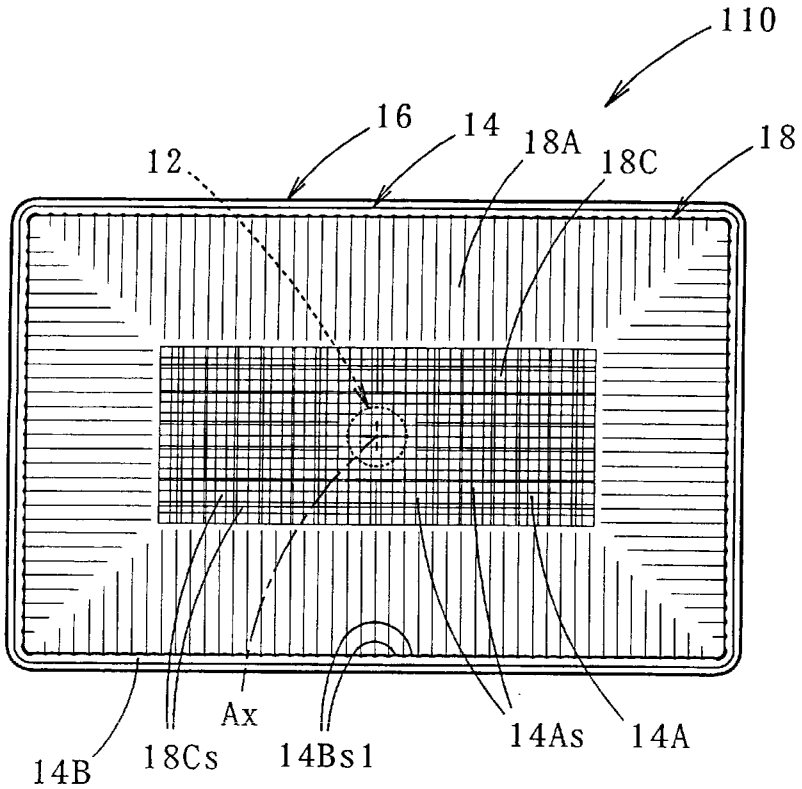

FIG. 10 is a diagram similar to FIG. 7, showing a second modification of the second embodiment.

As shown in FIG. 10, a translucent panel 18 differs from that of the first modification.

That is, in the translucent panel 18 in the second modification, an area near the optical axis Ax provided as the opening 18B in the first modification is provided with a vertical-planar non-half mirror portion 18C that is not half mirror-treated. Thus, the translucent panel 18 extends horizontally in a generally trapezoidal longitudinal sectional shape.

A plurality of lens elements 18Cs are formed in the entire area of a rear surface of the non-half mirror portion 18C (a central portion in the up-down direction). Each of the lens elements 18Cs has a fish-eye lens shape.

By adopting the above-described construction, it is possible to achieve substantially the same operation and advantages as in the first modification, and furthermore, to achieve the following operation and advantages.

Since the non-half mirror portion 18C having the plurality of lens elements 18Cs is formed in an area of the translucent panel 18 that is near the optical axis Ax, a lamp interior can be prevented from being clearly seen through the non-half mirror portion 18C both when the lamp is on and off. Furthermore, the appearance of the lamp can be changed when the lamp is turned on or off, but in a manner different from the manners of the first and second embodiments.

Furthermore, by suitably setting the surface configuration of each lens element 18Cs, the lamp light distribution can be easily controlled.

Figure 12:
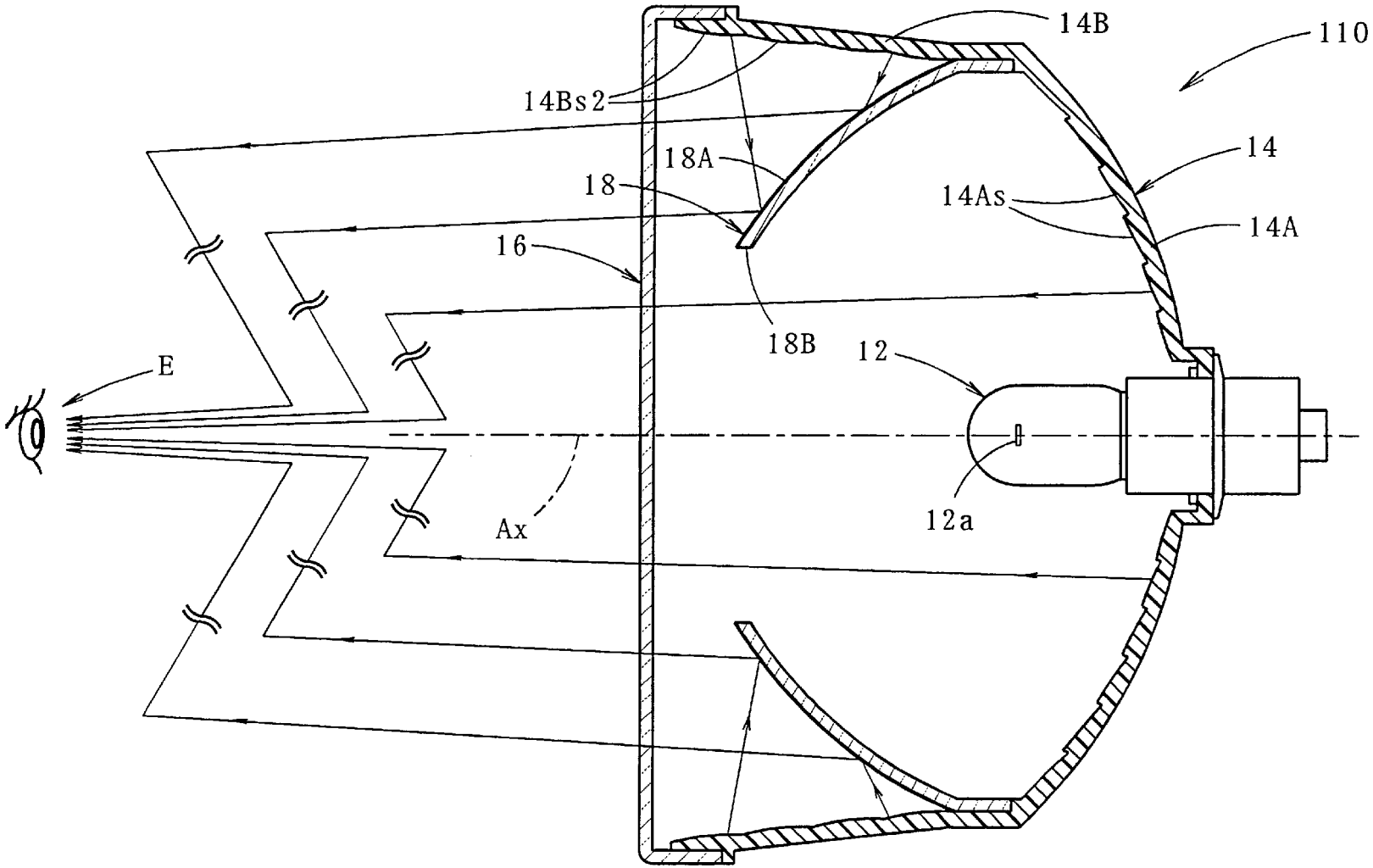
FIG. 12 is a diagram similar to FIG. 6, illustrating a third modification of the embodiment.

FIG. 12 is a diagram similar to FIG. 6, showing a third modification of the second embodiment.

As shown in FIG. 12, a translucent panel 18 and an upstanding wall portion 14B differ from those of the second embodiment.

That is, in the translucent panel 18 in this modification, the half mirror portion 18A is formed by a convex cylindrical curved plane extending in a direction of the periphery. The upstanding wall portion 14B in this modification is formed to forwardly expand slightly to an outer periphery side. An inner surface of the upstanding wall portion 14B has a plurality of quasi-reflector elements 14Bs2, each of which extends in a circumferential direction along the upstanding wall portion 14B and which are arranged in equal pitches in the fore-aft direction.

By adopting such a construction, the projections-and-depressions configuration formed in the inner surface of the upstanding wall portion 14B can be reflected as a distorted image in the translucent panel 18.

Figure 13B:
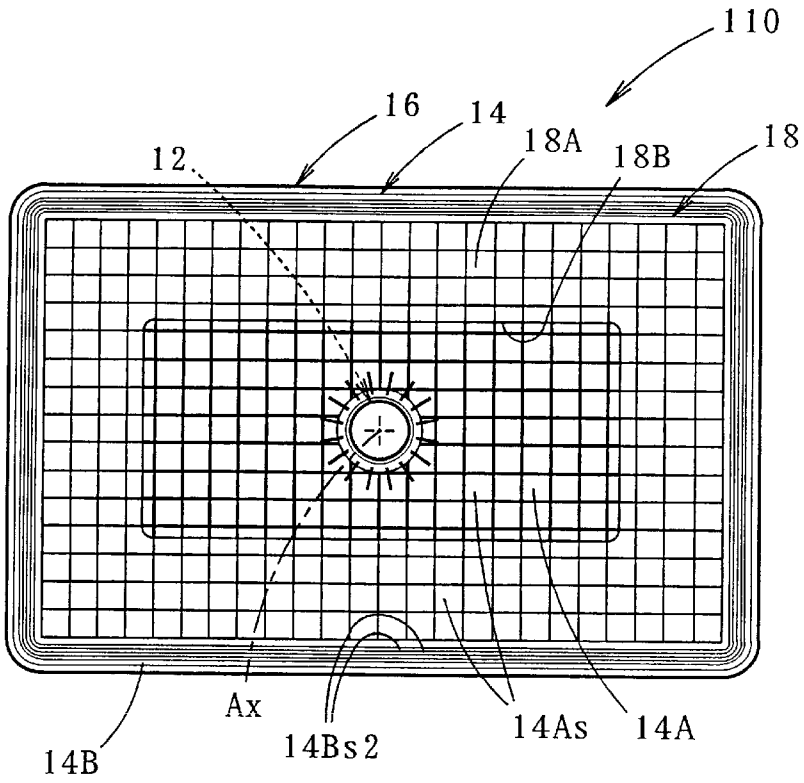
FIGS. 13(*a*) and 13(*b*) are diagrams similar to FIGS. 8(*a*) and 8(*b*), illustrating an operation of the third modification.
Figure 13A:
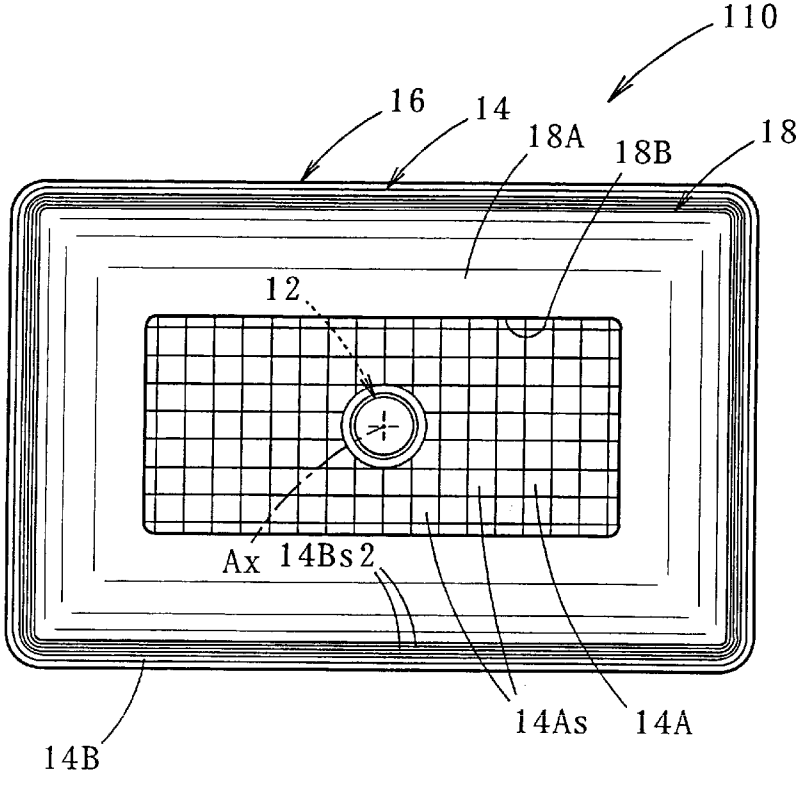

More specifically, the quasi-reflector elements 14Bs2 arranged in equal pitches in the fore-aft direction are reflected in the translucent panel 18 as stripes of gradually changing pitches, as shown in FIG. 13(*a*).

In the first and second embodiments and their modifications, the translucent panel 18 is provided within the lamp chamber defined by the lamp body 14 and the translucent cover 16. Therefore, the configuration of the translucent panel 18 can be set relatively freely.

Furthermore, since the lamp body 14 is formed as a portion of the lamp body 14, the positional precision of the upstanding wall portion 14B can be enhanced, so that a design can be reflected in the half mirror portion 11A substantially as intended.

A third embodiment of the invention will be described next.

Figure 14:
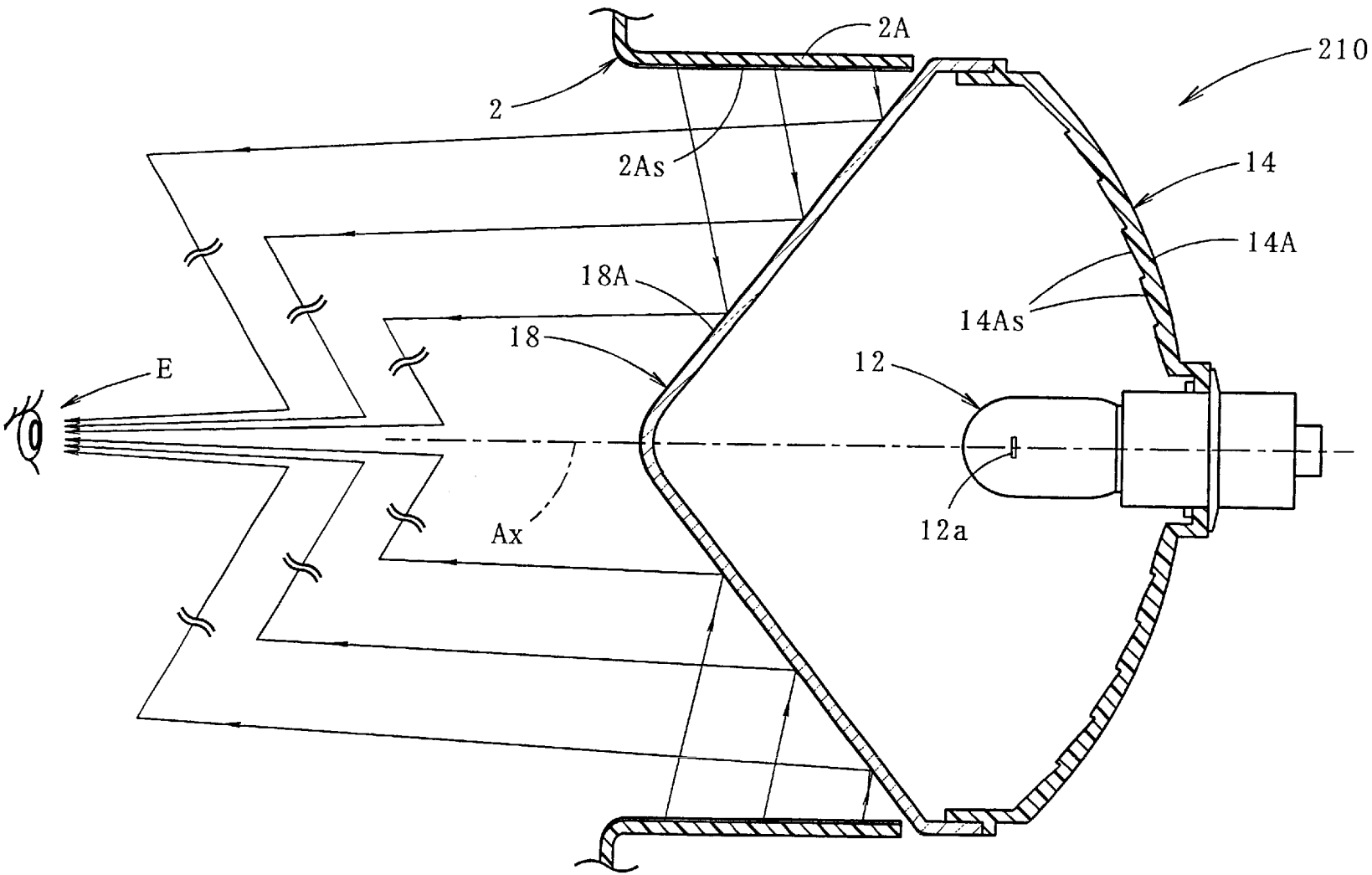
FIG. 14 is a diagram similar to FIG. 2, showing a vehicular lamp in accordance with still another embodiment of the invention.

FIG. 14 is a sectional view of a vehicular lamp 210 in accordance with this embodiment, illustrating how the lamp looks when off.

As shown in FIG. 14, in the vehicular lamp 210 of this embodiment, the translucent panel 18 is formed as an outer panel that functions as a translucent cover. A flange-like upstanding wall portion 2A formed as a portion of a vehicle body-side panel 2 extends in the fore-aft direction to surround the translucent panel 18. An inner surface of the upstanding wall portion 2A has a plurality of quasi-reflector elements 2As that extend in the fore-aft direction and that are arranged in equal pitches along the entire periphery. In this respect, the third embodiment has a construction different from that of the first embodiment.

The appearance of the vehicular lamp 210 observed from the eye point E at the forward direction of the optical axis Ax can be made substantially the same as the appearance in the first embodiment shown in FIG. 4, both when the lamp is on and off.

In the embodiments and the modifications described above, the lamp body 14 is provided with the reflector portion 14A for forwardly reflecting light from the light source bulb 12. Since the reflector portion 14A has a plurality of reflector elements 14As, it is possible to cause the reflector elements 14As to appear when the lamp is turned on.

Thus, the appearance of the lamp can be changed when the lamp is switched on or off.

A fourth embodiment of the invention will be described next.

Figure 15:
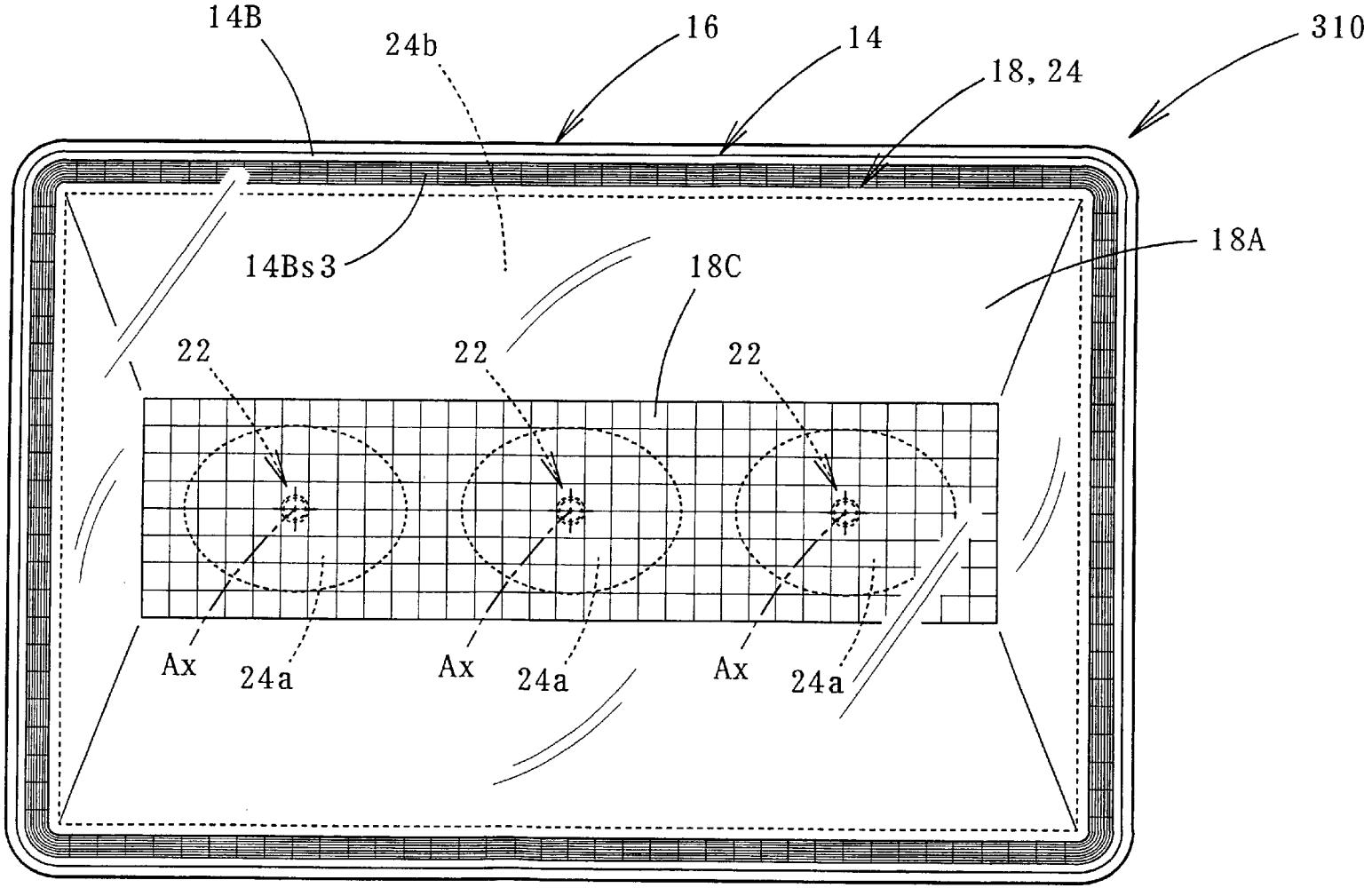
FIG. 15 is an elevation showing a vehicular lamp in accordance with an embodiment of the invention.

FIG. 15 is a front view of a vehicular lamp 310 in accordance with this embodiment.

Figure 16:
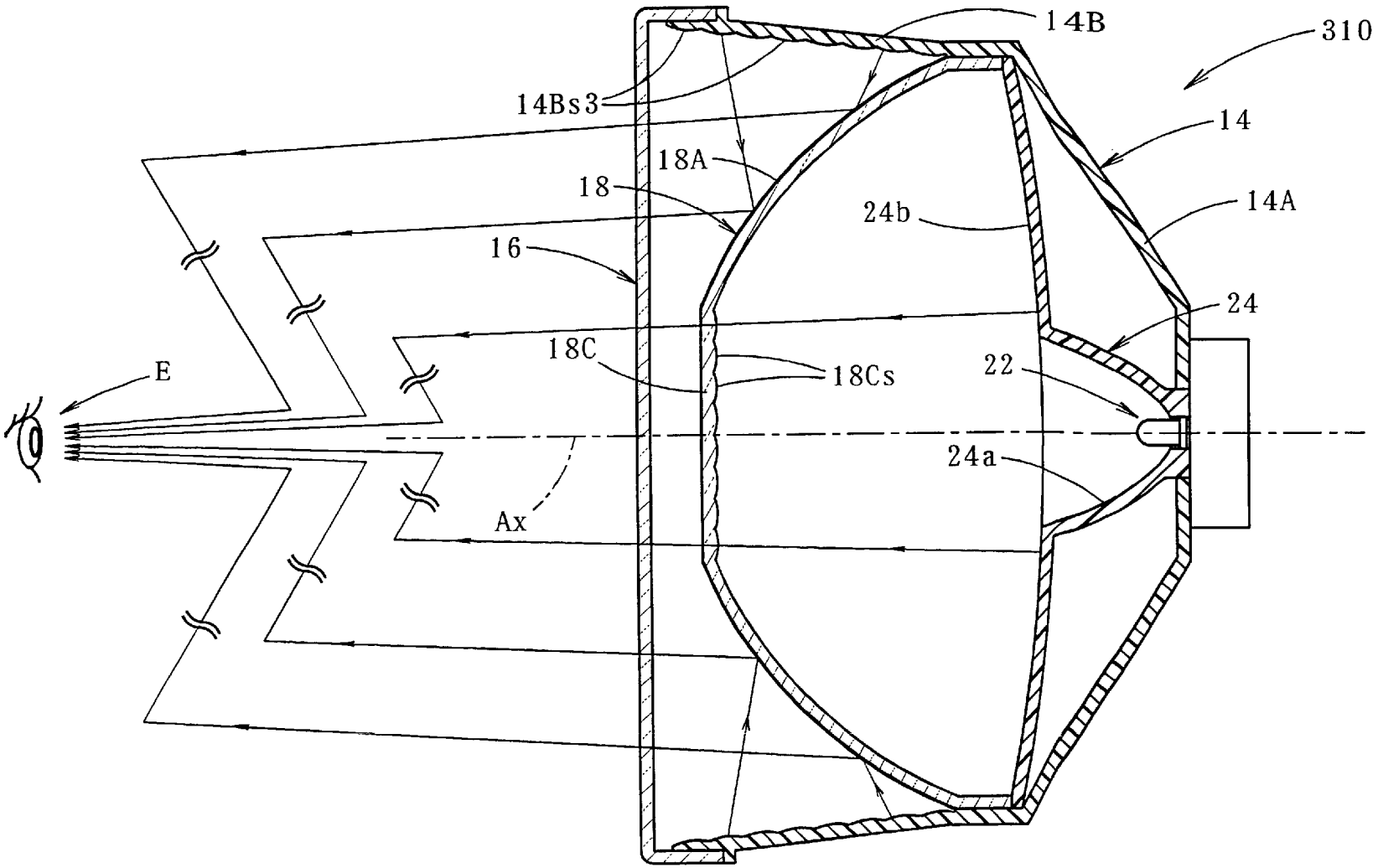
FIG. 16 is a side sectional view of a vehicular lamp turned off in accordance with an embodiment of the invention.
Figure 17:
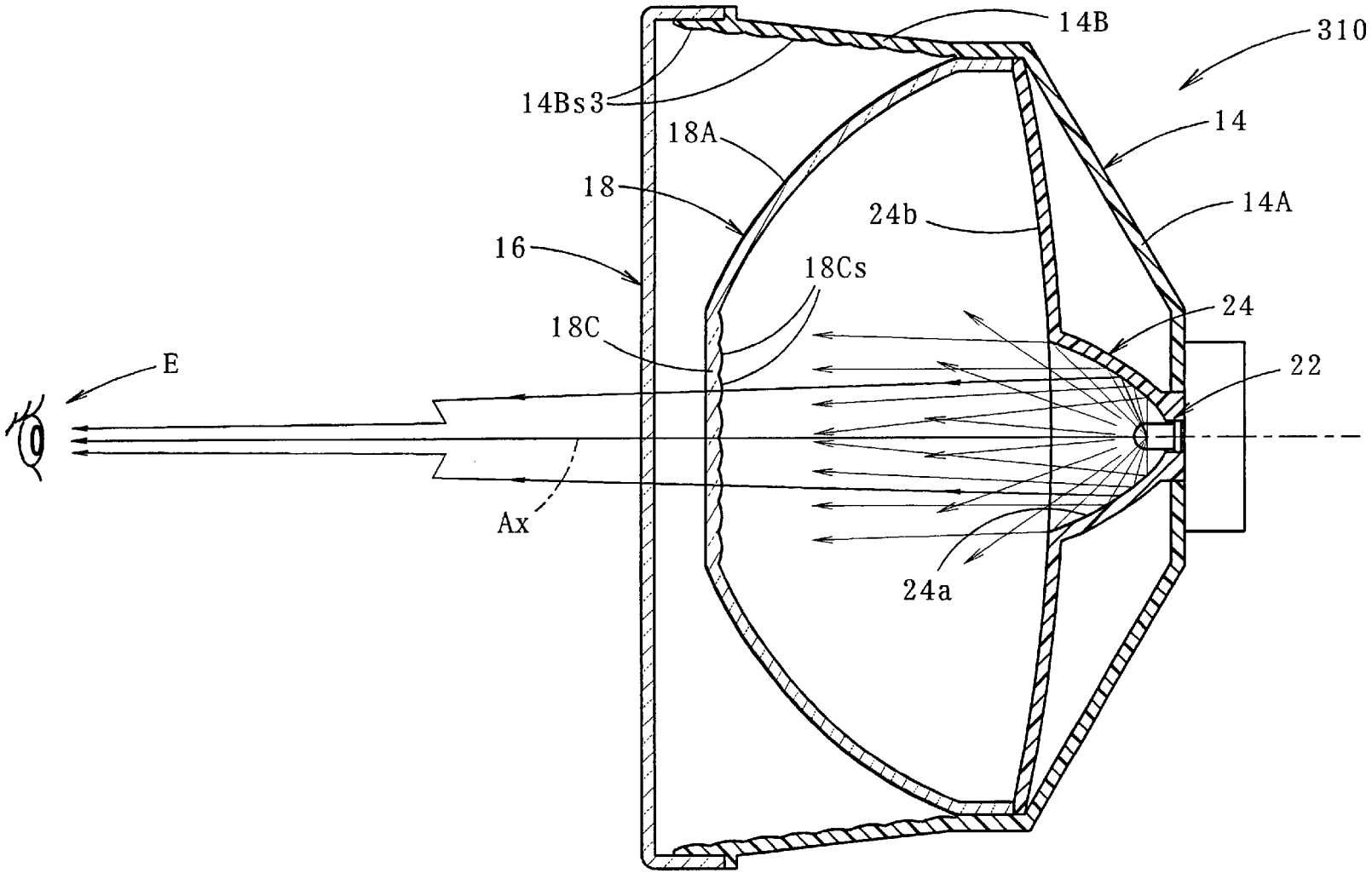
FIG. 17 is a side sectional view of the vehicular lamp turned on in accordance with an embodiment of the invention.

FIGS. 16 and 17 are side sectional views of the lamp. FIG. 16 illustrates how the lamp looks when off. FIG. 17 illustrates how the lamp looks when on.

As shown in these drawings, the vehicular lamp 310 of this embodiment is also a stop lamp. In this embodiment, a plurality of (three) LEDs 22 are employed as a light source.

These LEDs 22 are arranged in predetermined intervals in a horizontal direction.

Furthermore, a reflector 24 is provided as an independent member within the lamp chamber, as a substitute for the reflector portion 14A formed as a portion of the lamp body 14 as in the embodiments and the modifications described earlier.

This reflector 24 has small reflecting surfaces 24*a* that are formed at positions corresponding to the LEDs 22.

It is seen from a front view of the lamp that each small reflecting surface 24*a* is formed into a laterally long elliptical shape and is formed as a curved surface for forwardly reflecting light from the LED 22 in a slightly diffusing manner.

A portion around each small reflecting surface 24*a* in the reflector 24 is formed by a gentle concave curved surface 24*b*.

In a translucent panel 18 in this embodiment, a laterally long rectangular area positioned in front of the three small reflecting surfaces 24*a* is formed as a vertical planar non-half mirror portion 18C (a central portion in the up-down direction) that has not been half mirror-treated. A portion surrounding the non-half mirror portion 18C is formed as a half mirror portion 18A.

A plurality of lens elements 18Cs are formed in the entire area of a rear surface of the non-half mirror portion 18C. Each of the lens elements 18Cs has a fish-eye lens shape.

The half mirror portion 18A is formed by a convex cylindrical curved plane that extends in a circumferential direction.

An upstanding wall portion 14B in this embodiment is formed to forwardly expand slightly to an outer periphery side. An inner surface of the upstanding wall portion 14B has a plurality of quasi-reflector elements 14Bs3 that are formed in equal pitches in a lattice pattern.

The operation and advantages of the embodiment will be described next.

When the LEDs 22 of the vehicular lamp 310 is turned off, a reflection of the upstanding wall portion 14B in the half mirror portion 18A is observed from an eye point E on the optical axis Ax because of the external light reflecting off the half mirror portion 18A, as shown in FIG. 16.

Figure 18B:
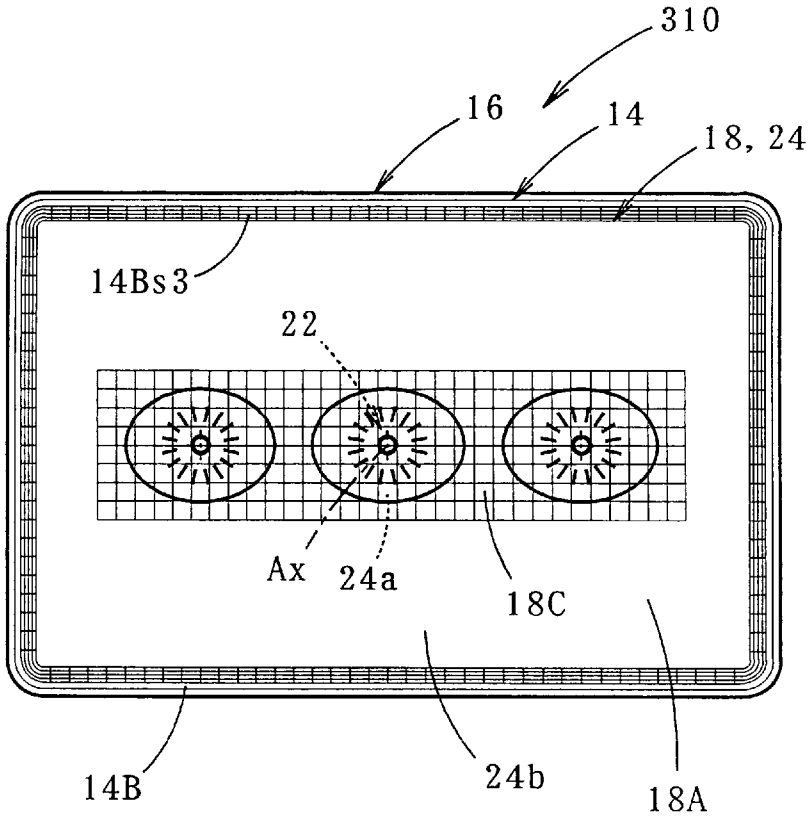
FIGS. 18(*a*) and 18(*b*) are elevations of a vehicular lamp turned off and on, respectively, in accordance with an embodiment of the invention.
Figure 18A:
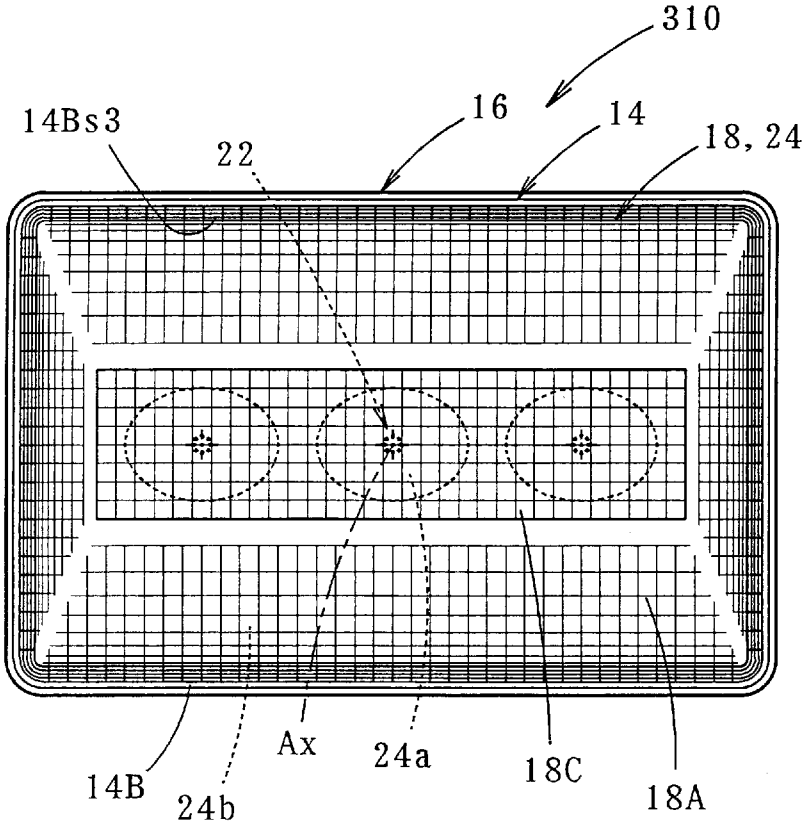

Therefore, as shown in FIG. 18(*a*), the vehicular lamp 310 appears as a lattice-like design because of the reflection of images of the plurality of quasi-reflector elements 14Bs3 formed in the inner surface of the upstanding wall portion 14B.

Since the half mirror portion 18A is formed by the convex cylindrical curved plane extending in a circumferential direction, the quasi-reflector elements 14Bs3 formed in equal pitches in a lattice arrangement are reflected in the half mirror portion 18A of the translucent panel 18 as a distorted lattice with the pitch gradually changing in one direction.

As for the non-half mirror portion 18C of the translucent panel 18, the lens elements 18Cs appear in a lattice-like design.

On the other hand, when the LEDs 22 of the vehicular lamp 310 is on, light coming directly from the three LEDs 22 and light reflected from the small reflecting surfaces 24*a* enter the non-half mirror portion 18C, and then reach the eye point E, as shown in FIG. 17.

Therefore, as shown in FIG. 18(*b*) the three LEDs 22 appear the brightest, and the three small reflecting surfaces 29*a* surrounding the LEDs 22 appear the next brightest, and the area of the surrounding non-half mirror portion 18C appears bright.

Light coming from the LEDs 22 does not directly impinge on the convex curved plane 24*b*. However, the convex curved plane 24*b* shines because of reflection of reflected and scattered light that occurs in the lamp chamber. Thus, the convex curved plane 24*b* also appears bright through the half mirror portion 18A.

Thus, according to this embodiment, the appearance of the lamp is changed when the lamp turned on or off, in a manner different from those of the first to third embodiments.

That is, in this embodiment, when the lamp is off, the inner surface of the upstanding wall portion 14B with the plurality of quasi-reflector elements 14Bs3 is reflected in the half mirror portion 18A. In comparison with the conventional vehicular lamp turned off, only a whitish reflection of a scene ahead of the translucent cover of the lamp appears. Thus, the lamp of the prevent invention gives an improved appearance.

In this embodiment in particular, the plurality of LEDs 22 are employed as a light source so that the lamp can be designed to appear with an effect that is totally different from the effect achieved by employing the filament 12*a* of the light source bulb 12 as a light source.

Furthermore in this embodiment, the distorted lattice-like design reflected in the half mirror portion 18A of the translucent panel 18 when the lamp is off changes to a no-pattern design of the convex curved plane 24*b* of the reflector 24 when the lamp is on. Thus, the appearance of the lamp is changed when the lamp is turned on or off.

According to the embodiment, a further different lamp design can be created by changing the number or arrangement of LEDs 22 or changing the configuration of each small reflecting surface 24*a*.

Although in the embodiments and the modifications described above, the vehicular lamps 10, 110, 210, 310 are stop lamps, similar operation and advantages can also be achieved in other kinds of vehicular lamps by adopting constructions similar to those of the embodiments and the modifications.

Several embodiments of the invention have been described herein, but it should be understood that various additions and modifications could be made which fall within the scope of the following claims.

What is claimed is:

1. A vehicular lamp comprising:

a light source member having an optical axis;

a translucent panel provided substantially in front of the light source member, at least a portion of the translucent panel being half mirror-treated; and an upstanding wall portion extending substantially in a fore-aft direction relative to the optical axis and disposed to surround at least a portion of the translucent panel, said upstanding wall portion comprising a plurality of quasi-reflector elements;

wherein the half mirror-treated portion is inclined at a predetermined angle with respect to the upstanding wall portion so that when the lamp is off, a reflection of the upstanding wall portion appears in the half-mirror treated portion.

2. A vehicular lamp according to claim 1, wherein the half mirror portion has a curved plane shape.

3. A vehicular lamp according to claim 1, further comprising:

a lamp body for supporting the light source member; and a translucent cover attached to the lamp body and defining a lamp chamber together with the lamp body;

wherein the translucent panel is provided in the lamp chamber, and the upstanding wall portion is formed as a portion of the translucent cover or the lamp body.

4. A vehicular lamp according to claim 1, further comprising:

a reflector extending from the light source member and coupled to the translucent panel; said reflector comprising a plurality of reflector elements.

5. A vehicular lamp according to claim 1, wherein a region in the translucent panel that is in front of the light source member forms an opening.

6. A vehicular lamp according to claim 1, wherein a region in the translucent panel in front of the light source member has not been half mirror-treated.

7. A vehicular lamp according to claim 6, wherein the translucent panel is formed to extend in a substantially horizontal direction in a generally trapezoidal longitudinal sectional shape, and each of an upper portion and a lower portion of the translucent panel is formed as the half mirror portion, and a central portion of the translucent panel in an up-down direction is formed as the non-half mirror portion, and the central portion in the up-down direction has a plurality of lens elements.

8. A vehicular lamp comprising:

a light source member having an optical axis;

a translucent panel provided substantially in front of the light source member, at least a portion of the translucent panel being half mirror-treated; and an substantially horizontal wall portion extending substantially in a fore-aft direction relative to the optical axis and disposed to surround at least a portion of the translucent panel, said upstanding wall portion comprising a plurality of quasi-reflector elements;

wherein the half mirror-treated portion is inclined at a predetermined angle with respect to the upstanding wall portion.

* * * * *